United States Patent [19]

Matthews

[11] 4,351,317

[45] Sep. 28, 1982

[54] APPARATUS FOR ATTACHING A FIRESCREEN TO A FIREPLACE

[76] Inventor: Ralph E. Matthews, P.O. Box 428, Decatur, Ala. 35602

[21] Appl. No.: 177,179

[22] Filed: Aug. 11, 1980

[51] Int. Cl.[3] ..... F24C 15/12

[52] U.S. Cl. ..... 126/139; 126/138; 248/226.4; 160/DIG. 9; 16/DIG. 11

[58] Field of Search ..... 126/138, 139, 141, 140; 248/225.3 R, 226.4; 160/DIG. 9; 16/DIG. 11

[56] References Cited

U.S. PATENT DOCUMENTS

| | | | |
|---|---|---|---|
| 1,757,301 | 5/1930 | Ferguson | 248/225.3 X |
| 1,858,967 | 5/1932 | Pettiegrew | 126/139 |
| 2,398,240 | 4/1946 | Merryweather et al. | 126/140 |
| 2,879,962 | 3/1959 | Biskup | 248/225.3 X |
| 2,901,203 | 8/1959 | Harrison | 248/225.3 |
| 2,963,250 | 12/1960 | Bott et al. | 126/138 X |
| 4,231,349 | 11/1980 | Livesay | 126/139 X |
| 4,290,409 | 9/1981 | Mays | 126/140 X |

*Primary Examiner*—Larry Jones

*Attorney, Agent, or Firm*—Woodford R. Thompson, Jr.

[57] ABSTRACT

A firescreen is secured in place by a flexible member attached at one end to the firescreen with the other end thereof secured to a bracket mounted in position for a portion thereof to extend upwardly in rearwardly spaced relation to the front side of the front wall of the fireplace. An actuator member connected to the bracket moves the bracket rearwardly away from an abutment carried by the fireplace intermediate the bracket and the firescreen whereby tension is applied to the flexible member to urge the firescreen rearwardly and downwardly, thus securing the firescreen to the fireplace.

10 Claims, 4 Drawing Figures

FIG. 1
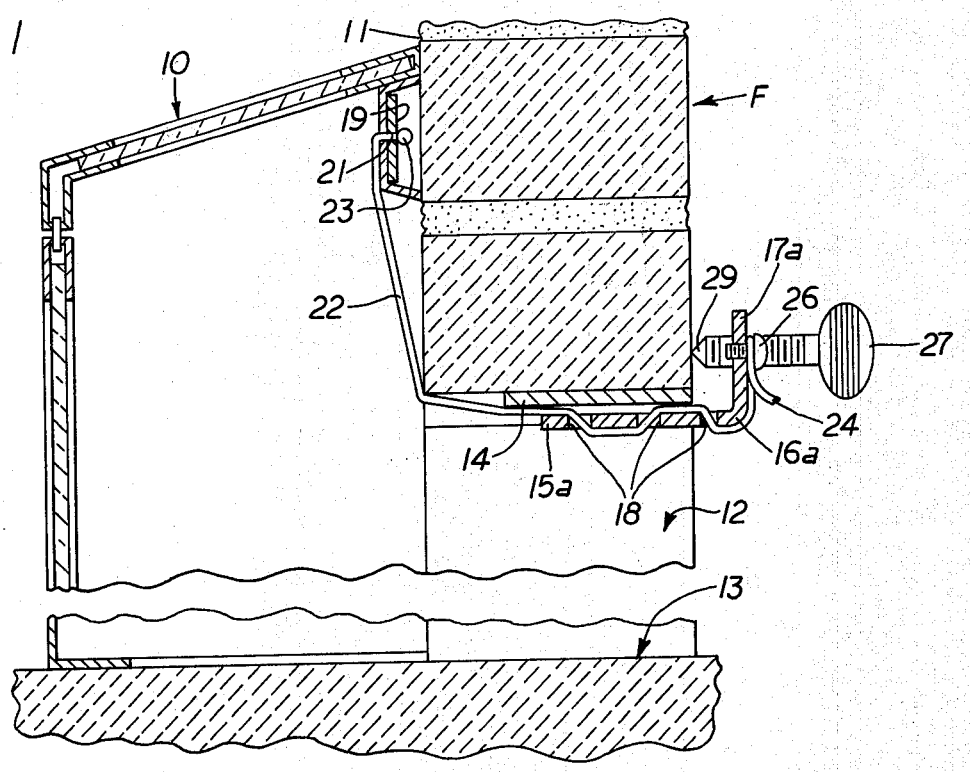
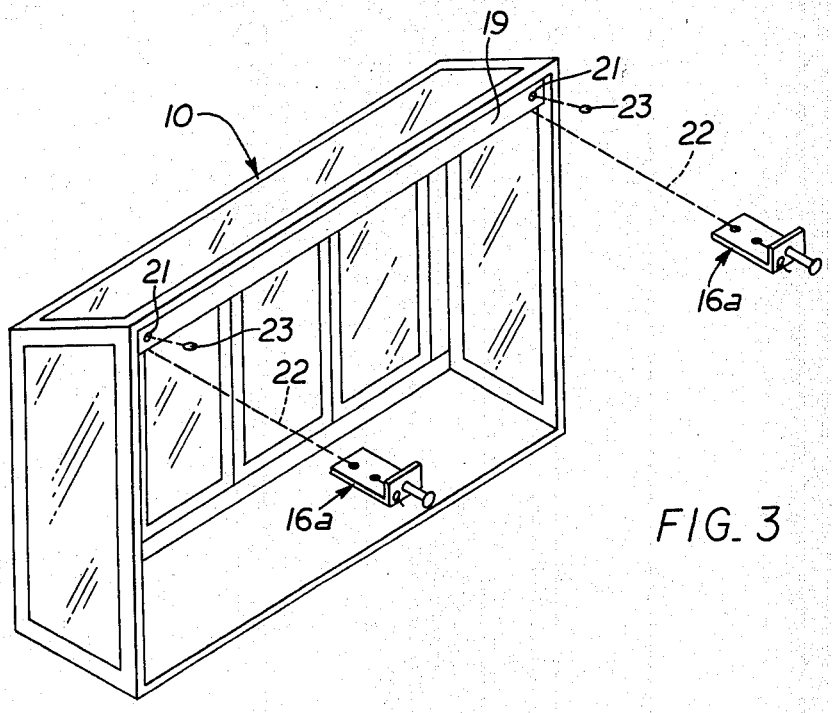
FIG. 3

APPARATUS FOR ATTACHING A FIRESCREEN TO A FIREPLACE

BACKGROUND OF THE INVENTION

This invention relates to an apparatus for attaching a firescreen to a fireplace and more particularly to an apparatus which is interposed between a firescreen and a fireplace.

Heretofore in the art to which my invention relates, many devices have been devised for attaching a firescreen to a fireplace. Difficulties have been encountered with these devices due to the fact that they are difficult to assemble and require a time-consuming effort to install so that the firescreen is firmly anchored in place. Also, prior art devices with which I am familiar are exposed to view and present an unsightly appearance.

SUMMARY OF THE INVENTION

In accordance with my invention I overcome the above and other difficulties by providing an apparatus for attaching a firescreen to a fireplace which is simple of construction and manufacture and requires a minimum of effort for installation in a quick and easy manner. Also, a positive connection is maintained between the firescreen and fireplace at all times. Furthermore, it is hidden from view and presents a more desirable appearance than the prior art devices mentioned above. My improved apparatus includes an actuator member adjustably connected to a generally L-shaped bracket with the actuator member adapted to engage an abutment, such as the rear side of the front wall of a fireplace adjacent the opening therein. A flexible member is interposed between the firescreen and the L-shaped bracket. Tension is applied to the flexible member when the actuator member moves the L-shaped bracket rearwardly away from the abutment, thereby securing the firescreen firmly to the fireplace.

DESCRIPTION OF THE DRAWINGS

Apparatus embodying features of my invention is illustrated in the accompanying drawings, forming a part of this application, in which:

FIG. 1 is a fragmental vertical sectional view through the firescreen and upper portion of the fireplace showing the firescreen in the assembled position;

FIG. 3 is a perspective view showing the rear side of a firescreen removed from the fireplace and showing points of attachment of the flexible member thereto; and, FIG. 4 is a perspective view showing a modified form of my invention in which the attaching bracket is connected to the inner sidewall of a fireplace.

DETAILED DESCRIPTION

Figure 2:
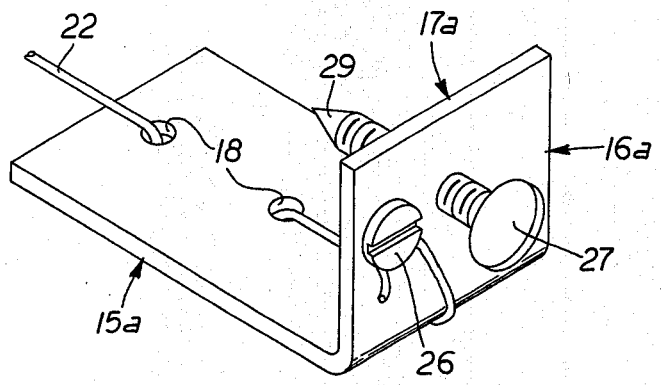
FIG. 2 is an enlarged perspective view showing an attaching bracket which is connected to one end of a flexible member and to the rear side of the front wall of the fireplace.

Referring now to the drawings for a better understanding of my invention, I show in FIG. 1 a firescreen 10 attached to the front side of the front wall 11 of a fireplace indicated generally at "F". The fireplace "F" is provided with the usual opening 12 and hearth 13. Such firescreens are disclosed in my co-pending U.S. applications, Ser. Nos. D-32,718 and D-32,719, both filed on Apr. 23, 1979.

Extending subjacent the usual lintel 14 for the fireplace "F" is a horizontal leg 15*a* of a generally L-shaped bracket 16*a*. The vertical leg 17*a* of the bracket 16*a* extends upwardly alongside an abutment such as the rear side of the front wall 11 of the fireplace adjacent the opening 12 therein. The horizontal leg 15*a* of the L-shaped bracket 16*a* is provided with a plurality of longitudinally spaced openings 18, as shown.

A transverse member 19 extends across the upper portion of the firescreen with its ends terminating adjacent the upper corners of the fireplace opening 12, as shown in FIGS. 1 and 3. Each end of the transverse member 19 is provided with an opening 21 as shown.

A flexible member, such as a cable 22, is threaded through each opening 21 and carries a retainer element 23 at one end thereof, with the retainer element 23 being of a size larger than the opening 21 so that it cannot pass through the opening 21. Accordingly, the retainer element 23 limits movement of the end of the cable 22 carrying the retainer element 23 relative to the transverse member 19. The retaining element 23 is preferably in the form of a ball-like member; however, it will be understood that the retainer element 23 could assume other forms. The other end 24 of the cable 22 is passed sequentially through the openings 18 in the horizontal leg 15*a* of the L-shaped bracket 16*a* and is detachably connected to the vertical leg 17*a* by suitable means such as a retaining screw 26.

An actuator member, such as an elongated threaded member 27, is in threaded engagement with a threaded opening 28 in the vertical leg 17*a* of the L-shaped bracket 16*a*. The threaded member 27 may be in the form of a thumb screw having a tapered end 29 which engages the rear side of the front wall 11 of the fireplace "F" adjacent the opening 12 therein, as shown in FIG. 1.

From the foregoing description, the operation of my improved apparatus for attaching a firescreen to a fireplace, shown in FIGS. 1–3, will be readily understood. The rear side of the firescreen 10 is positioned adjacent the front side of the front wall 11 of the fireplace. Each cable 22 carrying a retainer element 23 is threaded through an opening 21 in the transverse member 19, as shown in FIG. 1, whereby the retainer element 23 prevents separation of the cable 22 from the transverse member 19. The end 24 of the cable 22 is then threaded sequentially through the longitudinally spaced openings 18 in the horizontal leg 15*a* of the L-shaped bracket 16*a*. The openings 18 aid in securing and locating the cable 22 relative to the bracket 16*a*. The end 24 of the cable 22 is then secured to the vertical leg 17*a* by the retaining screw 26, as shown. After securing the cable 22 to the vertical leg 17*a*, the elongated threaded member 27 is rotated in a direction to move the L-shaped bracket 16*a* rearwardly away from the rear side of the front wall 11 of fireplace "F," whereby tension is applied to the cable 22 to thus urge the firescreen 10 into firm engagement with the front side of the front wall 11 of the fireplace and the hearth 13. That is, the downward force exerted by the cable 22 pulls the firescreen rearwardly and downwardly whereby it moves rearwardly toward the fireplace and downwardly toward the hearth.

Figure 4:
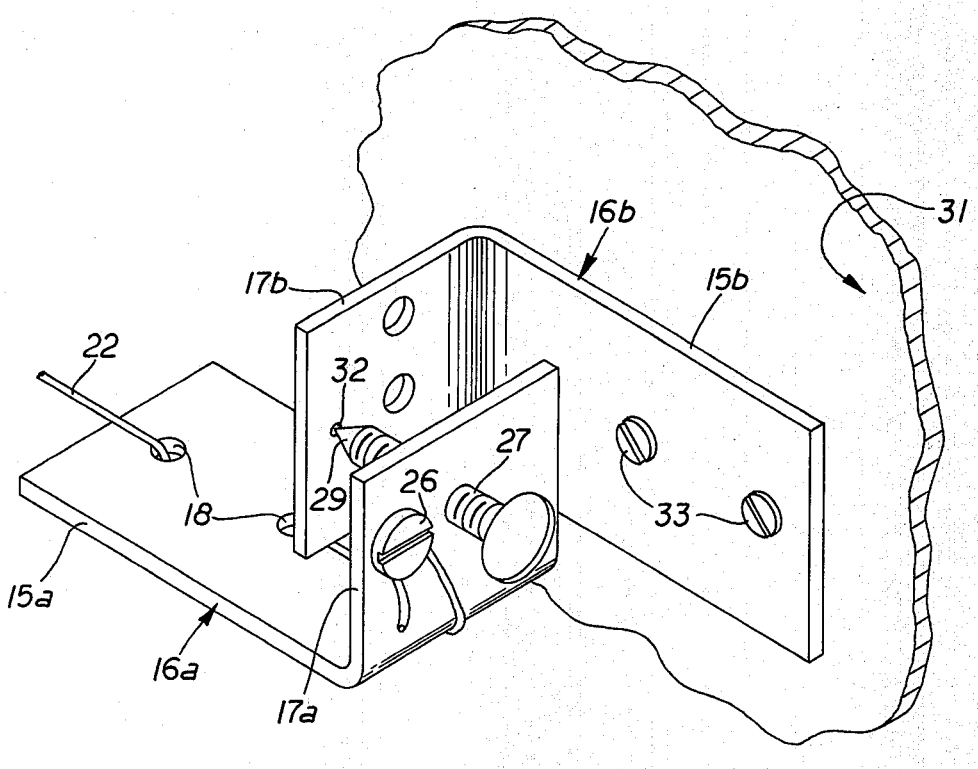

In FIG. 4, I show a modified form of my invention. An abutment in the form of an L-shaped bracket 16*b* is mounted on each side wall 31 of the fireplace intermediate the vertical leg 17*a* of the L-shaped bracket 16*a* and the front side of the front wall of the fireplace. The L-shaped bracket 16*b* is substantially identical to the L-shaped bracket 16*a* described above. The leg 15*b* of bracket 16*b* extends alongside the side wall 31 of the fireplace and the leg 17*b* extends laterally and inwardly from the side wall 31. A recess 32 is provided in the leg 17*b* in position to receive the tapered end 29 of the elongated threaded member 27. The L-shaped bracket 16*b* is mounted on the side wall 31 by suitable means, such as retaining screws 33.

From the foregoing description, the operation of the modified form of my invention shown in FIG. 4 will be readily understood. The L-shaped bracket 16*b* is mounted on each side wall 31 as shown. The firescreen 10 is then positioned adjacent the front side of the fireplace "F." As described hereinabove, each cable 22 is secured at one end to the transverse member 19 extending across the upper portion of the firescreen and the other end thereof is secured to the vertical leg 17*a* of the L-shaped bracket 16*a*. After cable 22 is secured in place, the elongated threaded member 27 is then rotated in a direction so that its tapered end 29 engages the recess 32 in the L-shaped bracket 16*b* and moves the bracket 16*a* rearwardly away from the transverse member 19. This rearward movement of the bracket 16*a* causes tension to be applied to the cable 22, thus pulling the firescreen rearwardly toward the fireplace and downwardly toward the hearth thus securing the firescreen to the fireplace.

From the foregoing, it will be seen that I have devised an improved apparatus for attaching a firescreen to a fireplace which is simple of construction and can be quickly and easily assembled with a minimum of effort to anchor the firescreen in place. Also, my apparatus is hidden from view and presents a more desirable appearance than devices heretofore employed. Furthermore, my apparatus positively secures the firescreen in place at all times by applying a constant tension to the flexible member thus pulling the firescreen both rearwardly toward the fireplace and downwardly toward the hearth.

While I have shown my invention in two forms, it will be obvious to those skilled in the art that it is not so limited, but is susceptible of various other changes and modifications without departing from the spirit thereof.

What I claim is:

1. In a firescreen assembly disposed to surround the front side of the front wall of a fireplace adjacent the opening therein and having a transverse member adapted to span the front side of the front wall of the fireplace above the opening for the fireplace, the improvement which comprises:

(a) at least one generally L-shaped bracket having a vertical leg adapted to extend upwardly in rearwardly spaced relation to said front side of said front wall and a forwardly extending horizontal leg, (b) there being at least one opening in said horizontal leg, (c) there being an opening through said transverse member above the opening for the fireplace, (d) a cable-like member having one end thereof extending through said opening in said transverse member with the other end thereof passing through said opening in said horizontal leg, (e) means carried by said one end of said cable-like member limiting movement of said one end relative to said transverse member, (f) means detachably connecting said other end of said cable-like member to said vertical leg of said bracket, (g) an abutment carried by said fireplace intermediate said vertical leg and said front side of said front wall of the fireplace, and (h) an actuator member adjustably connected to said vertical leg and adapted to engage said abutment and move said bracket rearwardly away from said transverse member to thereby apply tension to said cable-like member and urge said transverse member both rearwardly and downwardly to secure said firescreen to said fireplace.

2. A firescreen assembly as defined in claim 1 in which said means carried by said one end of said cable-like member limiting movement of said one end relative to said transverse member is a retainer element which is larger than said opening, so as to prevent separation of said cable-like member from said transverse member.

3. A firescreen assembly as defined in claim 2 in which said retainer element is a ball-like element.

4. A firescreen assembly as defined in claim 1 in which said means detachably connecting said cable-like member to said vertical leg is a retaining screw in threaded engagement with said vertical leg.

5. A firescreen assembly as defined in claim 1 in which said actuator member comprises:

(a) an elongated threaded member in threaded engagement with a threaded opening through said vertical leg and having one end thereof in engagement with said abutment, and (b) means to rotate said elongated threaded member in a direction to move said bracket rearwardly away from said transverse member to thereby apply tension to said cable-like member and move said firescreen rearwardly and downwardly toward the fireplace.

6. A firescreen assembly as defined in claim 5 in which said end of said elongated threaded member in engagement with said abutment is tapered.

7. A firescreen assembly as defined in claim 1 in which a plurality of longitudinally spaced openings are provided in said horizontal leg of said L-shaped bracket and said cable-like member passes sequentially through said longitudinally spaced openings.

8. A firescreen assembly as defined in claim 1 in which said abutment is a second generally L-shaped bracket mounted on each side wall of said fireplace having one leg extending alongside said side wall and a second leg extending laterally and inwardly from said side wall.

9. A firescreen assembly as defined in claim 8 in which said second leg of said second generally L-shaped bracket is provided with a recess in position to receive said tapered end of said elongated threaded member.

10. A firescreen assembly as defined in claim 1 in which said abutment is the rear side of said front wall of said fireplace.

* * * * *